US009500406B2

(12) United States Patent
Friess et al.

(10) Patent No.: US 9,500,406 B2
(45) Date of Patent: Nov. 22, 2016

(54) DRYER WITH MONITORING DEVICE

(71) Applicants: Wolfgang Friess, Iffeldorf (DE); Manfred Resch, Tittmoning (DE); Michael Wiggenhorn, Munich (DE)

(72) Inventors: Wolfgang Friess, Iffeldorf (DE); Manfred Resch, Tittmoning (DE); Michael Wiggenhorn, Munich (DE)

( * ) Notice: Subject to any disclaimer, the term of this patent is extended or adjusted under 35 U.S.C. 154(b) by 95 days.

(21) Appl. No.: 14/576,888

(22) Filed: Dec. 19, 2014

(65) Prior Publication Data

US 2015/0101208 A1 Apr. 16, 2015

Related U.S. Application Data

(63) Continuation of application No. 13/139,927, filed as application No. PCT/EP2009/009303 on Dec. 29, 2009, now Pat. No. 8,919,007.

(30) Foreign Application Priority Data

Dec. 29, 2008 (EP) ..... 08022515

(51) Int. Cl.
*F26B 5/06* (2006.01)

(52) U.S. Cl.
CPC ..... *F26B 5/06* (2013.01)

(58) Field of Classification Search
CPC ..... F26B 5/00; F26B 5/04; F26B 5/44; F26B 5/06; F26B 13/18; G01D 21/00; G01D 3/036; G01D 9/005; G01D 11/245; G01L 1/24; G01L 5/00
USPC ..... 34/381, 426, 427, 497, 90, 104, 105, 34/524; 356/731; 606/21, 22, 23, 167; 250/227.18, 231.1, 337, 461.1; 73/862.55, 866.5
See application file for complete search history.

(56) References Cited

U.S. PATENT DOCUMENTS

| | | | |
|---|---|---|---|
| 5,355,423 | A | 10/1994 | Phillips |
| 5,367,786 | A | 11/1994 | Jennings |
| 6,125,216 | A | 9/2000 | Haran |
| 6,848,196 | B2 | 2/2005 | Brulls |
| 7,048,732 | B2 | 5/2006 | Ellingsen |
| 7,424,186 | B2 | 9/2008 | Arab-Sadeghabadi |
| 7,520,670 | B2 | 4/2009 | Schwegman |

(Continued)

FOREIGN PATENT DOCUMENTS

| | | | |
|---|---|---|---|
| DE | 102004031324 | A1 | 12/2004 |
| DE | 102006025700 | A1 | 12/2007 |
| DE | 102007053664 | A1 | 5/2009 |

(Continued)

OTHER PUBLICATIONS 2007 hand-book "Adaptronics and Smart Structures: Basics, Materials, Design, and Applications" by Hartmut Janocha, p. 15, last paragraph.

(Continued)

*Primary Examiner* — Stephen M Gravini
(74) *Attorney, Agent, or Firm* — Dennemeyer & Associates, LLC

(57) ABSTRACT

The invention provides a monitoring device (32) for a dryer (10) includes a means for sensing a physical parameter, such as temperature or strain, at a sensing locus within the dryer (10), for example at a vial (20). The sensing means comprises an optical sensing fiber (38) having at least one fiber Bragg grating (54). Moreover, the invention provides a dryer, in particular a freeze dryer (10), which is equipped with such monitoring device (32).

16 Claims, 9 Drawing Sheets

(56) References Cited

U.S. PATENT DOCUMENTS

| | | | | |
|---|---|---|---|---|
| 8,919,007 | B2 * | 12/2014 | Friess | F26B 5/06 250/231.1 |
| 2015/0101208 | A1 * | 4/2015 | Friess | F26B 5/06 34/284 |

FOREIGN PATENT DOCUMENTS

| | | | | |
|---|---|---|---|---|
| EP | 2202472 | A1 * | 6/2010 | F26B 5/06 |
| JP | 07308180 | A | 11/1995 | |
| WO | 2006107278 | A | 10/2006 | |

OTHER PUBLICATIONS 1997 journal article "Fiber Bragg Grating Technology—Fundamentals and Overview" by Hill and Meltz in Journal Of Lightwave Technology, vol. 15, No. 8, Aug. 1997, chapter "VIII. Grating Based Sensors".

* cited by examiner

DRYER WITH MONITORING DEVICE

RELATIONSHIP TO PRIOR APPLICATIONS

This application is a continuation of application Ser. No. 13/139,927, filed on Jun. 15, 2011, and now pending.

BACKGROUND

Drying processes, such as the drying of liquids and their conversion into solid materials, are standard operations in various industries including the pharmaceutical and food industries. Common types of dryers include tray dryers, spray dryers, fluid bed dryers, vacuum dryers, belt dryers, and freeze dryers.

Freeze drying is a drying method which has gained substantial importance in particular in the manufacture of drug products for injectable use comprising biotechnology-derived active ingredients. One of the reasons for this is that freeze drying allows the gentle manufacturing of sensitive products even under aseptic conditions. Freeze drying, however, is a complex process usually consisting of three major steps: freezing, primary drying and secondary drying. During freezing, the water will form ice crystals, and solutes will be confined to the interstitial region in a liquid, glassy or crystalline state. In the course of primary drying, the pressure on the product is reduced and applied heat results in the sublimation of the ice. Primary drying is complete when the ice crystals have been removed. At this stage, water is still absorbed onto the surface of a cake resulting from the solutes. In many cases the moisture level is too high and final products may not have the desired stability. Therefore the moisture desorption is usually accomplished in a secondary drying step by increasing the temperature and reducing the pressure.

The sequential approach with different impact on the product performance considering also the formulation requires substantial effort for understanding and control. In a FDA Guidance for Industry, the concept of "Process Analytical Technology" (PAT), a framework for innovative pharmaceutical manufacturing and quality assurance, was established (Guidance for Industry: PAT—A Framework for innovative Pharmaceutical Development, Manufacturing, and Quality Assurance, published 29 Sep. 2004). The initiative is based on process understanding, acknowledgement of process variability and risk-based understanding to increase quality, reduce loss and obtain greater control of the manufacturing process.

Various PAT-tools are known. Batch methods comprise pressure rise analysis, spectroscopy based measurements like tuneable diode laser absorption spectroscopy, mass spectrometry to determine the relative amounts of the compounds in the freeze-dryer atmosphere, electric moisture sensors, pirani/capacitance manometry. Single vial measurement methods comprise temperature probes, conductivity probes, microbalances, NIR-spectroscopy, Raman-spectroscopy and offline analytics after sampling.

The product temperature profile is one of the most critical parameters in drying, in particular freeze-drying. The collapse temperature or glass transition temperature of the formulation at different stages of the process at different water content may reflect an upper acceptable limit of the product temperature. The product temperature also defines the endpoints of primary and secondary drying. The product temperature is affected by various different parameters such as resistance of the material to heat and vapour flow, the formulation or the position in the freeze-dryer.

Product temperature monitoring during a freeze-drying cycle is traditionally performed using either thin wire thermocouples or resistance thermal detectors. However, the invasive product temperature measurements performed with these detectors in a single vial are not representative for the entire batch due to variations in the nucleation and freezing behaviour of the solution containing the probe. The vials tend to show a lower degree of supercooling than the surrounding vials and therefore form fewer and larger ice crystals which finally results in lower product resistance and shorter drying time relative to the rest of the batch. While these difference may be inconsequential in the laboratory, the sterile and particle-free environment in manufacturing leads to substantially higher supercooling of the solution, resulting in larger differences between vials with and vials without temperature sensors. Accordingly, the existing temperature sensors have a substantial impact on the structure and the drying behaviour of the products as they strongly impact the ice formation process. Therefore, the information gained from known conventional temperature sensors is limited in its usefulness for process development and control. Due to individual wiring of each sensor as a parallel connection handling with numerous wires can become difficult and container closure can be negatively affected. Furthermore, in samples of limited space or volume they cannot be applied and multiple measuring points in one sample or vial can hardly be achieved. Overall sensitivity and precision of these standard temperature sensors are rather limited.

In US 2003/0116027 A1 a method for monitoring a freeze-drying process in a freeze dryer holding one or more samples is described, which uses an optical fiber assembly to monitor the temperature of a sample. The monitoring system is operated by extrinsic spectroscopy. Radiation is generated in a radiation analyzer and transmitted to the sample in the freeze dryer via optical fibers. The incident radiation is directed onto the sample, whereupon radiation diffusely reflected from the sample is collected by the optical fiber and carried back to the radiation analyzer to be analyzed spectrally. For this purpose each optical fiber is guided through a wall portion of a vacuum chamber of the freeze dryer to reach a sample container. The optical fiber is arranged outside the container, the distal end of the fiber being arranged close to or against a wall portion of the container. The container is made of a material that is transparent to radiation in the relevant wavelength range. Also the end of the optical fiber can be arranged in direct contact with the probe. In a specific embodiment, the device is operated with near infrared radiation (NIR) in the range corresponding to the wavelengths from about 700 to 2,500 nm.

However, this monitoring device has several drawbacks. Most importantly, it requires an interaction of the radiation with the sample material which is to be dried. Hence, the material can only be contained in vessels which are transparent to the radiation that is used (i.e. NIR). Secondly, in order to monitor multiple samples within the dryer simultaneously, the number of fibers and optical channels would have to be multiplied as well, thus resulting in a complex and expensive monitoring system. Thirdly, the method is not particularly sensitive and, for example, does not appear to be suitable to detect the small differences in temperature between different vials located in various positions in a dryer during a drying cycle.

It is therefore an object of the present invention to provide a monitoring device for a dryer which overcomes at least one of the disadvantages associated with prior art monitoring systems and devices. It is a further object of the invention to provide an improved monitoring device suitable for a freeze dryer.

In a further aspect, it is an object of the invention to provide a monitoring device for dryers, in particular for freeze dryers, which is easy to handle, requires only a small number of components and is cost-effective.

A further object is to provide a monitoring device for dryers which is capable of simultaneously monitoring the temperature profiles of a plurality of samples.

A yet further object is to provide a monitoring device for a dryer which allows for a better control of the manufacturing process and enhanced quality assurance during drying, in particular freeze-drying, in particular of pharmaceutical products.

It is a further object of the invention to provide a monitoring device for a dryer that ensures a high sensitivity and sampling rate.

It is a yet further object to provide a monitoring device for a dryer which allows the monitoring of further physical parameters in addition to temperature.

In a further aspect, it is an object of the invention to provide a dryer which allows the monitoring of a drying process and overcomes one or more of the disadvantages of known dryers.

It is also an object to provide an improved method for drying materials, in particular for freeze drying pharmaceutical products.

Further objects will become apparent from the description of the invention and the patent claims.

SUMMARY OF THE INVENTION

In a first aspect, the invention provides a novel and improved monitoring device for a dryer according to claim 1. In a second aspect, it provides a dryer comprising such monitoring device. Moreover, it provides a method for drying a material which is performed in a dryer comprising such monitoring device.

The monitoring device of the invention includes a means for sensing a physical parameter at a sensing locus within the dryer, which means comprises an optical sensing fiber having at least one fiber Bragg grating. The dryer may, for example, be a freeze dryer, and the sensing locus may be at a container such as a vial which holds material to be dried. One of the preferred physical parameters is temperature.

In a specific embodiment, the monitoring device includes a means for sensing a physical parameter at a plurality of sensing loci within the dryer, and this means comprises an optical sensing fiber having a plurality of fiber Bragg gratings which are positioned serially in distinct medially located longitudinal sections of the sensing fiber.

DETAILED DESCRIPTION OF THE INVENTION

Figure 2:
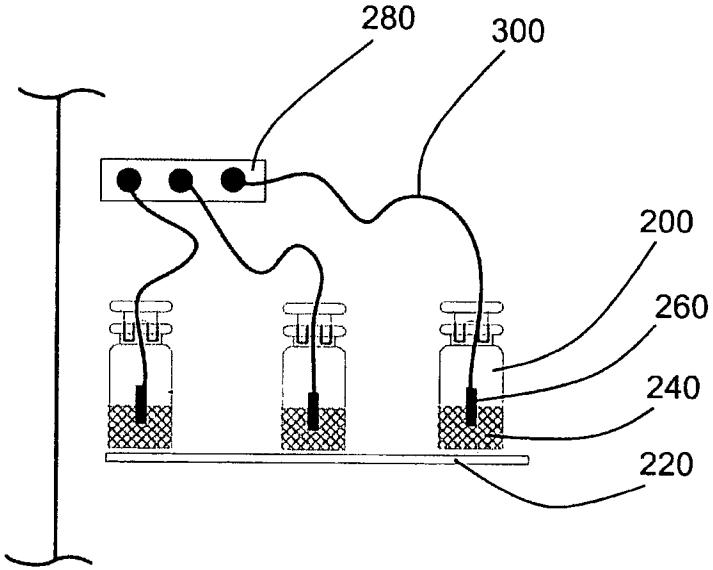
FIG. 2 shows a detail of the freeze dryer of FIG. 1.

The present invention provides a monitoring device which includes a means for sensing a physical parameter at a sensing locus within the dryer. The sensing means comprises an optical sensing fiber having at least one fiber Bragg grating.

The invention is based on the discovery that optical sensors comprising fiber Bragg gratings, which are per se known but have never been used in dryers such as freeze dryers, not only allow for an improved monitoring and control of the overall drying process and for a precise determination of the endpoint of a drying phase; surprisingly, they also markedly increase the sensitivity of temperature measurement, even up to a level which allows the detection of minutes energetic transitions, such as the glass transition of a small amount of sample material in a vial. Moreover, since it is easily possible to use sensing fibers with multiple fiber Bragg gratings without substantially increasing the complexity of the monitoring system, the monitoring device of the invention provides a simple and convenient method for the simultaneous measurement of temperature at multiple sites in a dryer, e.g. to determine the degree of uniformity of the drying conditions at the respective sites or loci. A further major advantage is that fiber sensors with fiber Bragg gratings allow the monitoring and even simultaneous measurement of other physical parameters, in particular force. For example, one and the same optical sensor is capable of measuring the temperature at a vial in a dryer and the weight of the vial. Further effects and advantages will be described below.

As mentioned, optical sensors with fiber Bragg gratings are per se known and used in other technical fields to measure e.g. temperatures. For example, US 2002/0147394 A1 describes an insertion probe for sensing distributed temperature in biological media, useful e.g. in the field of cryosurgery. The probe comprises a tube containing at least one optical fiber, which is inscribed with at least one Bragg grating at its distal end. The tube is also sealed at its distal end to separate the fiber sensor from the environment (e.g.

from the tissue fluids) and provided with a tip, so that it can be inserted into a body material for measuring the temperature within a body or tissue.

In a preferred embodiment, the fiber Bragg grating used according to the present invention is not positioned at the distal end of a sensing fiber, but rather in a longitudinal section which is medially located. In this way, the same fiber may be designed to have a plurality of Bragg gratings, each of which may be placed in a different sensing locus in the dryer. It is in fact one of the further preferred embodiments that the sensing fiber has at least two Bragg gratings. In another specific embodiment, the sensing fiber has at least four Bragg gratings.

Bragg gratings are made by illuminating the core of a suitable optical fiber with a spatially-varying pattern of intense UV laser light. Short-wavelength (<300 nm) UV photons have sufficient energy to break highly stable silicon-oxygen bonds of such fibers, damaging the structure of the fiber and increasing its refractive index slightly. A periodical spatial variation in the intensity of UV light, caused by the interference of two coherent beams or a mask placed over the fiber, gives rise to a corresponding periodic variation in the refractive index of the fiber. This modified fiber serves as a wavelength selective mirror: light travelling down the fiber is partially reflected at each of the tiny index variations, but these reflections interfere destructively at most wavelengths and the light continues to propagate down the fiber uninterrupted. However, at one particular narrow range of wavelengths, constructive interference occurs and light is returned down the fiber.

The fiber Bragg grating has certain useful characteristics: The sensor is a modified fiber. It has the same size as the original fiber and can have virtually the same high strength. Because information about the fiber Bragg grating is encoded in the wavelength of the reflected light, fiber Bragg gratings are immune to drifts and have no down-lead sensitivity. The responses to strain and temperature are linear and additive and the fiber Bragg grating itself requires no on-site calibration. Multiple gratings can be combined in a single fiber by taking advantages of multiplexing techniques inspired by the telecommunications industry. This gives fiber Bragg grating sensor systems the important property of being able to simultaneously read large numbers of sensors on a very few fibers, leading to reduced cabling requirements and easier installation. The fiber and the sensor is immune to any EMI.

The fundamental principle behind the operation of a FBG, is Fresnel reflection. Where light travelling between media of different refractive indices may both reflect and refract at the interface. The grating will typically have a sinusoidal refractive index variation over a defined length. The reflected wavelength ($\lambda_B$), called the Bragg wavelength, is defined by the relationship $$\lambda_B = 2n\Lambda \tag{1}$$

where n is the effective refractive index of the grating in the fiber core and $\Lambda$ is the grating period. In this formula, n is the average refractive index in the grating:

$$n = \frac{n_3 + n_2}{2}$$

The wavelength spacing between the first minimums (nulls), or the bandwidth ($\Delta\lambda$), is given by $$\Delta\lambda = \left[\frac{2\delta n_0 \eta}{\pi}\right]\lambda_B \tag{2}$$

where $\delta n_0$ is the variation in the refractive index ($n_3 - n_2$), and $\eta$ is the fraction of power in the core.

The peak reflection ($P_B(\lambda_B)$) is approximately given by $$P_B(\lambda_B) \approx \tanh^2\left[\frac{N\eta(V)\delta n_0}{n}\right] \tag{3}$$

where N is the number of periodic variations. The full equation for the reflected power ($P_B(\lambda)$), is given by $$P_B(\lambda) = \frac{\sinh^2\left[\eta(V)\delta n_0\sqrt{1-\Gamma^2}\,N\Lambda/\lambda\right]}{\cosh^2\left[\eta(V)\delta n_0\sqrt{1-\Gamma^2}\,N\Lambda/\lambda\right]-\Gamma^2}, \tag{4}$$

wherein $$\Gamma(\lambda) = \frac{1}{\eta(V)\delta n_0}\left[\frac{\lambda}{\lambda_B} - 1\right] \tag{5}$$

The structure of the FBG can vary via the refractive index, or the grating period. The grating period can be uniform or graded, and either localised or distributed in a superstructure. The refractive index has two primary characteristics, the refractive index profile, and the offset. Typically, the refractive index profile can be uniform or apodized, and the refractive index offset is positive or zero.

There are six common structures for the FBGs provided for the fiber 38: uniform positive-only index change, Gaussian apodized, raised-cosine apodized, chirped, discrete phase shift, and superstructure.

Apodized Gratings.

There are basically two quantities that control the properties of the FBG. These are the grating length, $L_g$, given as, $$L_g = N\Lambda, \tag{6}$$

and the grating strength, $\delta n_0\ \eta$. There are, however, three properties that need to be controlled in a FBG. These are the reflectivity, the bandwidth, and the side-lobe strength. According to equation (2) above, the bandwidth depends on the grating strength, and not the grating length. This means the grating strength can be used to set the bandwidth. The grating length, effectively N, can then be used to set the peak reflectivity according to equation (3), which depend on both the grating strength and the grating length. The result of this, is that the side-lobe strength can not be controlled, and this simple optimisation results in significant side-lobes. A third quantity can be varied to help with side-lobe suppression. This is apodization of the refractive index change. The term apodization refers to the grading of the refractive index to approach zero at the end on the grating. Apodized gratings offer significant improvement is side-lobe suppression while maintaining reflectivity and a narrow bandwidth. The two functions typically used to apodize a FBG are Gaussian and raised-cosine.

Chirped Fiber Bragg Gratings.

The refractive index profile of the grating may be modified to add other features, such as a linear variation in the grating period, called a chirp. The chirp had the effect of broadening the reflected spectrum. The reflected wavelength, given by equation (1), will change relative to any change in the grating period. A grating possessing a chirp has the property of adding dispersion—namely, different wavelengths reflected from the grating will be subject to different delays. This property has been used in the development of phased-array antenna systems and polarization mode dispersion compensation, as well.

Tilted Fiber Bragg Gratings.

In standard FBGs, the grating or variation of the refractive index is along the length of the fiber (the optical axis), and is typically uniform across the width of the fiber. In a tilted FBG (TFBG), the variation of the refractive index is at an angle to the optical axis. The angle of tilt in a TFBG has an effect on the reflected wavelength, and bandwidth.

Long-Period Gratings.

Typically the grating period is the same size as the Bragg wavelength, as defined in equation (1). So for a grating that reflects at 1500 nm, the grating period is 500 nm, using a refractive index of 1.5. Longer periods can be used to achieve much broader responses than are possible with a standard FBG. These gratings are called long-period fiber grating. They typically have grating periods on the order of 100 micrometers, to a millimeter, and are therefore much easier to manufacture.

Fiber Bragg grating sensors may be used for measuring force (via strain) or temperature, since the Bragg wavelength is also sensitive to temperature. In a FBG sensor, the measurand causes a shift in the Bragg wavelength, $\Delta\lambda_B$. The relative shift in the Bragg wavelength, $\Delta\lambda_B/\lambda_B$, due to an applied strain ($\in$) and a change in temperature ($\Delta$T) is approximately given by, $$\left[\frac{\Delta\lambda_B}{\lambda}\right] = C_S\epsilon + C_T\Delta T, \tag{7}$$

or, $$\left[\frac{\Delta\lambda_B}{\lambda}\right] = (1 - p_e)\epsilon + (\alpha_\Lambda + \alpha_n)\Delta T. \tag{8}$$

Here, $C_S$ is the coefficient of strain, which is related to the strain optic coefficient pe. Also, $C_T$ is the coefficient of temperature, which is made up of the thermal expansion coefficient of the optical fiber, $\alpha_\Lambda$, and the thermo-optic coefficient, $\alpha$.

A further particular advantage of the monitoring device of the invention is that optical sensing fibers with Bragg gratings, in contrast to thermocouples, are not affected by electrical or magnetic fields. Moreover, they do not generate any electrical or magnetic fields themselves. In fact, they apply only minute amounts of energy to the sensing locus or sample which are highly unlikely to have any impact on the sample material, which is a very significant advantage in the context of freeze drying, in particular when sensitive pharmaceutical products are freeze dried.

A further advantage of the invention is that the optical sensor signal may be sampled at a very high frequency, e.g. 1 kHz or higher, which may be used to detect very rapid changes in the physical parameter which is measured, e.g. rapid temperature changes. Further contributing to the high response rate, resolution and sensitivity of the fiber sensor is its small mass.

An example of a suitable optical sensing fiber is a Draw Tower Grating (DTG) fiber. These fibers are high strength coated Bragg gratings which can be mounted directly on a structure without coating removal. Their typical core diameter is about 5 to 6 μm, depending on the wavelength that it is operated with. For use with a centre wavelength of 1510 to 1590 nm, which is according to one of the preferred embodiments, and in particular in the range from about 1525 to about 1575 nm, the core diameter is about 6 μm. Other variants have a core diameter of about 5 μm and can be used with a wavelength of about 810 to 860 nm. The core is typically covered with a cladding, which may have a diameter of e.g. about 125 μm. The cladding may be coated with a suitable jacket or coating, preferably a high strength coating such as Ormocer®. A typical diameter of the coated fiber may be in the region of about 200 μm, such as 195 μm. Ormocers® are a family of non-crystalline, optically transparent, inorganic-organic hybrid polymers. However, alternative coating materials may also be used, such as polyimides or polyacrylates. Preferably, the coating material and thickness are selected to result in a high tensile strength, such as more than 30 N, or even more than 50 N.

The Bragg gratings are typically about 5 to 10 mm long, such as about 8 mm, which ensures a reflectivity of typically more than 15% using a wavelength in the range of about 1550 nm. Such sensing fibers may be used for broad operating temperature ranges, such as from about −180° C. to about 200° C.

To further increase the mechanical strength of the sensing fiber while retaining its flexibility, it may be further covered with another coating such as a tubular holder. Such tube may be made from an inert, temperature-resistant, strong and flexible material. In a specific embodiment, the tubular holder is a Teflon® (PTFE) tube. It may not be necessary to cover the whole sensing fiber, but the tube is advantageously applied to at least the segment or segments of the fiber which are curved or bent, in particular if such curved segment or segments contain a Bragg grating. The tubular holder enables to form and stabilize the fiber in a preferred form, such as the helix and/or spiral mentioned above. The tubular holder may form a kind of tunnel in which the fiber may move or slide.

In a further preferred embodiment, the section in which the at least one fiber Bragg grating is located is a curved section. Advantageously, the section is curved over an angular range of at least 180°. The advantage of this embodiment is that it provides an easy and convenient way of bringing one or more fiber Bragg grating to selected sensing loci such as to one or more vials. As mentioned, a typical application of freeze drying is the lyophilisation of parenteral drug products, and often these drug products are contained in vials. For example, to sense the temperature at a selected vial, the sensing segment of a sensing fiber (i.e. a segment which comprises a Bragg grating) may be bent such as to form a loop which extends toward the vial. It may also be curved such as to be insertable into the vial. Optionally, the curved section may actually be inserted into the vial during the monitoring process, and for example positioned in the space above the fill material contained within the vial. Alternatively, the curved section may actually be inserted into the fill material within the vial which is to be dried. Obviously, if the material to be dried is contained within another type of container than a vial, the same considerations are applicable to such other container as well. Moreover, instead of forming the sensing section of the fiber into a loop, it may also be curved such as to form a spiral, a circle, an ellipse, or a helix.

In order to hold the sensing fiber and in particular the curved section with the Bragg grating in place, any appropriate fastener or fixing means may be used, such as a cramp or retaining clip. In another preferred embodiment, the fixing means is in the form of a sensing rod, which is a stiff or flexible hollow cylinder through which the sensing fiber may be guided. In particular, the fiber is guided through the rod in such a way that a Bragg grating is located at or near the end of the sensing rod. Preferably, the Bragg grating is in a curved section of the sensing fiber which extends from the sensing rod. The curved range or section of the sensing fiber forms a kind of sensor tip which may be placed directly above or even in contact with the material to be freeze dried or the content of a vial. An advantage of this embodiment is therefore that it enables the formation of a very small sensor which is easily insertable into a small sensing locus.

A curved section of the sensing fiber may also comprise two or more fiber Bragg gratings. In particular, if the curved section is in the form of a helix or of a spiral, the presence of two or more Bragg grating would allow the simultaneous measurement at multiple distinct sensing loci within a container comprising a material or sample to be dried. Therefore, in a further preferred embodiment the monitoring device includes a sensing helix, the sensing helix including a sensing fiber such that at least two fiber Bragg gratings of the sensing fiber are located at different axial dimensions of the sensing helix. The helix thus forms a kind of coil or screw, reaching into the respective probe space and providing measuring points in three dimensions. In a yet further preferred embodiment, the monitoring device includes a sensing spiral, wherein the sensing spiral includes the sensing fiber such that at least two fiber Bragg gratings of the sensing fiber are located at different radial dimensions of the sensing spiral. The sensing spiral also provides several sensing points in a single layer or level of the material to be dried, which may be contained within a container such as a vial.

Another preferred way of fixing, holding or supporting the sensing fiber is by affixing it to, or incorporating it in, a support unit adapted to support a material which is to be dried, such as a shelf, a rack, a tray, a trough, a plate, a grid, or any other type of support on which such material may be placed within a dryer. The support will normally be adapted to either hold a material to be dried as such or, as it would be typical for freeze dryers, as a support for one or more containers which may be placed on it. In any case, the sensing fiber may be guided on or beneath the surface of the support unit to the at least one sensing locus. In other words, the support unit may comprise a plurality of supporting areas on which a sample or samples may be placed, and the sensing fiber traverses at least some of the supporting areas, and is provided with a fiber Bragg grating at one or more of those places where it traverses the supporting areas.

Several further advantages are associated with this particular embodiment. For example, a supporting plate or grid with a sensing fiber mounted thereto is a simple and easily handled sensor plate or grid for monitoring the selected physical parameter at multiple sensing loci. Instead of filling a freeze dryer and then positioning the desired number of fiber Bragg gratings in the desired sensing loci, a sensor plate could be inserted into the freeze dryer and then the sample to be dried, e.g. a number of vials, could be placed on the sensing unit in such a way that one or more selected vials are positioned at the sensing loci, which is a very quick and efficient method for bringing the sensors and the samples selected for sensing loci together.

Another advantage of this embodiment is that it enables the efficient measurement of more than one physical parameter at one or more sensing loci. In particular, such assembly could be used to conveniently monitor one or more temperatures as well as one or more forces simultaneously. For example, the temperature at, and weight of, selected vials in a freeze dryer could be monitored, thus allowing an exceptionally close monitoring of the freeze drying process and the changes occurring in the vials.

In order to measure the weight of a container such as a vial within a dryer, the container is placed on a supporting area which is traversed by the sensing fiber and where the sensing fiber exhibits a Bragg grating. Depending on the size and shape of the container, it may be useful or necessary to place the container on two or more sensing loci with Bragg gratings. Alternatively, a shim or a means with a similar function may be placed on a support unit at the sensing locus, and the container on the shim. In many other cases, however, it will be sufficient to simply place a vial on the sensing locus in order to measure its weight.

Irrespective of the way or method by which the sensing fiber and in particular the fiber section or sections comprising a Bragg grating are positioned and held in place, it is furthermore preferred that the sensing fiber has a plurality of fiber Bragg gratings which are positioned serially in distinct medially located longitudinal sections of the sensing fiber. Thus, this preferred monitoring device provides a means for sensing a physical parameter at a plurality of sensing loci within the dryer. In particular, the monitoring device may comprise two or more sensing rods through which a sensing fiber is directed, or it may comprise two or more sensing loci on a support unit.

Since a sensing fiber may be designed to have several, for example two, four, ten, twenty, or even more serially positioned fiber Bragg gratings which provide for as many sensing loci, the substantial advantages of this embodiment are immediately evident. The highly efficient monitoring of sophisticated drying processes with high sensitivity and with high spatial and temporal resolution is enabled without any significant increase in apparatus complexity, using a small number of easily assembled components only.

In a further specific embodiment, an optical sensing fiber having a plurality of fiber Bragg gratings which are positioned serially in distinct medially located longitudinal sections of the sensing fiber is used to monitor the temperature of apparatus components of a dryer, such as the temperature of a shelf or rack on which material to be dried may be placed. In the case of freeze dryers, for example, these shelves typically incorporate a fluid-conducting system in the form of a fluid channel or system of channels. The fluid-conducting system is designed to achieve an appropriate cooling capacity and an even temperature distribution. According to a specific embodiment, the sensing fiber is located at, or affixed to, the fluid-conducting system. For example, it may be inserted into a fluid channel or glued onto the external surface of a fluid channel. In this way, it can be used to measure and monitor the temperature distribution along the fluid-conducting system and/or the dryer shelf. A particular advantage of this embodiment is that it enables the evaluation of novel dryer (or shelf) designs. It may also advantageously be used for the purpose of qualifying new drying equipment or for monitoring the performance of a dryer. Preferably, the monitoring device according to this embodiment is used for a freeze dryer.

If it is desired to further increase the number of sensing loci, it is easily possible to use two or more sensing fibers, each of which may be provided with a plurality of serial, medially located fiber Bragg gratings.

The one or more sensing fibers are preferably connected to an interrogator, and the interrogator may be coupled with a computer. If two or more sensing fibers are used in the monitoring device, they may be conveniently connected to the same interrogator which is selected to be able to support two or more optical channels.

Using a plurality of sensing fibers each preferably having several Bragg gratings is particularly advantageous for thoroughly investigating a drying process. For example, several support units or sensor plates as described above could be used to monitor and evaluate a drying process at different horizontal levels within a dryer. A plurality of sensing fibers is also useful for simultaneously monitoring a variety of parameters, such as the weight of selected vials, the temperature at selected vials, and the temperature of the sample material contained within selected vials. In this case, it may also be useful, for example, to combine one or more sensing fibers affixed to (or incorporated within) a support unit with one or more sensing fibers guided through sensing rods which are insertable into containers.

Moreover, a plurality of sensing fibers each having a plurality of Bragg gratings is advantageously used for simultaneously monitoring one or more physical parameter such as temperature and/or force at a plurality of sensing loci within a dryer, wherein some of the sensing loci are at (or within) a material to be dried, and other sensing loci are within apparatus components of the dryer without contact to a material to be dried or a container holding such material. For example, one or more such sensing fibers may be positioned such as to be used for monitoring the product to be dried, and another one or more such sensing fibers may be positioned such as to enable the monitoring of the dryer performance, e.g. in or at a cooling fluid channel within a rack or shelf, or elsewhere within the dryer.

In a further aspect, the invention provides an improved dryer which is characterised in that it comprises a monitoring device as described herein-above. The advantages of such dryer over known dryers result directly from the advantages of the inventive monitoring device.

The particular advantages of the dryer provided by the invention may be of crucial value in at least two applications. Firstly, in the context of research or process development, the dryer equipped as described herein will provide a much more thorough understanding of critical process variables and their impact on the quality of the product of any drying process, and will thereby allow a better and more rational setting of process parameters than previously available dryers. Secondly, in the context of routine manufacture, the novel dryer will allow a far more precise control of the drying process according to pre-determined operating corridors and product parameters.

The dryer may be any type of dryer for which a sensing monitor is required or useful, such as a fluid bed dryer, vacuum dryer, rotary dryer, spray dryer, tray dryer, tunnel dryer, infrared dryer, or freeze dryer. In a preferred embodiment, the dryer is a freeze dryer.

The freeze dryer provided by the invention is particularly useful for drying sensitive materials such as pharmaceutical products comprising active ingredients selected from anti-infective drugs, proteins, peptides, oligonucleotides, RNA such as siRNA, DNA, and hybrid molecules. It is also very useful for drying sensitive colloidal drug carrier systems such as nanoparticles, liposomes, lipid complexes, and the like. Moreover, it is useful for aseptically drying parenteral drug products which cannot be sterilized or which are difficult to sterilize.

In yet a further aspect, the invention provides a novel drying method. The method is characterised in that it is performed in a dryer as described above, i.e. in a dryer comprising a monitoring device as disclosed herein.

In a further aspect, the invention provides a method for monitoring a drying process which is characterised in that it includes the use of a monitoring device as described herein-above.

According to the invention, a monitoring device according to the invention was implemented into a freeze dryer to monitor drying processes. Surprisingly, the results obtained were far superior to the standard thermocouple temperature measurements. Thus, using a fiber Bragg grating made it possible to make product temperature profile to be a very important, even the leading parameter in the freeze-drying process. According to the invention, freeze-drying processes can be monitored at higher sensitivity and sampling rate. Additional processes in the sample during freezing such as crystallization can be monitored. Processes in the samples can be monitored without contact to the sample. The sensors according to the invention are much easier to handle due to smaller size, less cables and the possibility of multiple measurements points on one fiber line.

The invention is further illustrated by reference to the drawings which represent some of the preferred embodiments or aspects thereof.

Figure 1:
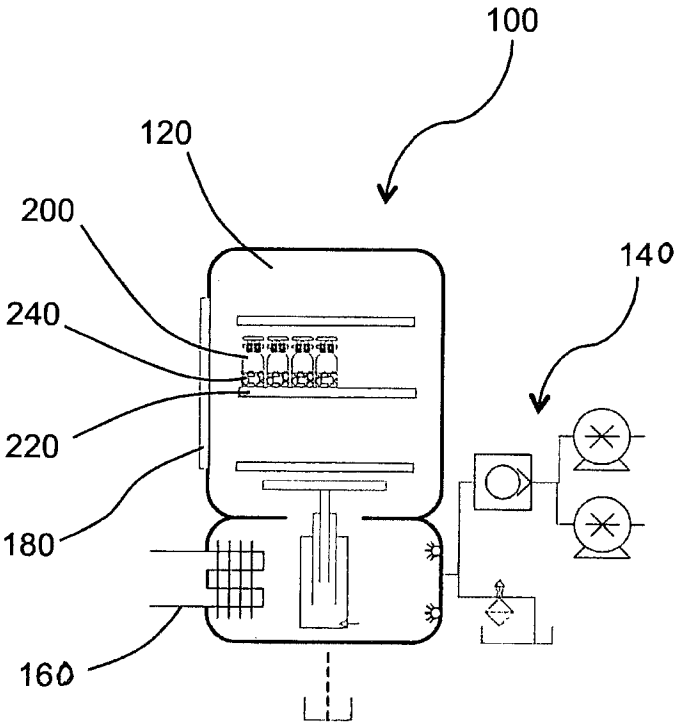
FIG. 1 shows a side sectional view of a freeze dryer according to prior art.

In FIG. 1 a freeze dryer 100 according to prior art is shown, including a drying chamber 120 having a compressor 140 and an ice condenser 160 associated therewith. The drying chamber 120 is closed by means of a door 180, behind which several vials 200 are located on a shelf or rack 220. The vials 200 contain a product or material 240 to be freeze dried.

Figure 3:
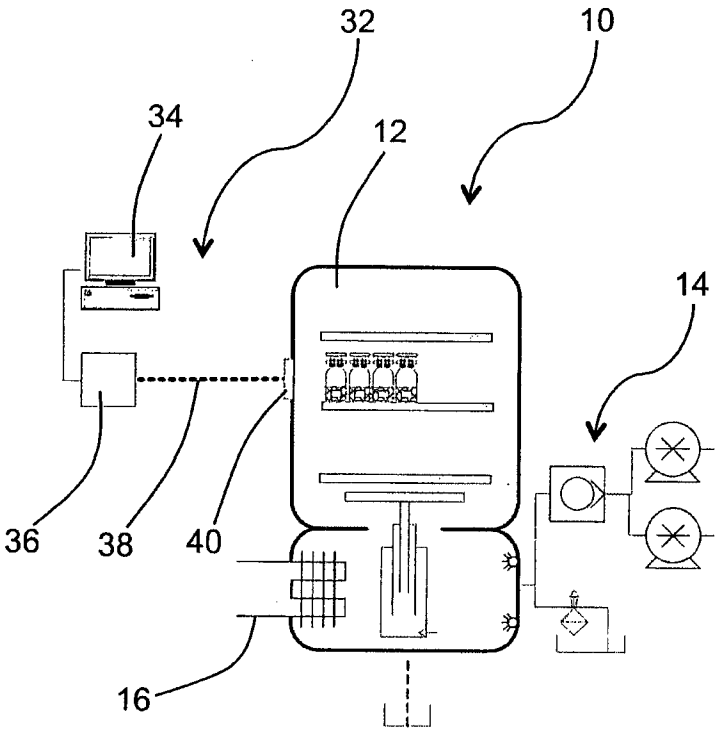
FIG. 3 shows a side sectional view of a specific embodiment of the freeze dryer according to the invention.

Referring to FIG. 2, a detail of the interior of the freeze dryer of FIG. 3 is shown, with several vials 200 on a shelf or rack 220. Each vial 200 further contains a temperature sensor in the form of a thermocouple 260 being conductively connected to a temperature measuring device 280 via wires or electrical conducts 300. The temperature measuring device 280 allows at least a rough supervision of the temperature during the process of freeze drying. For this purpose, the thermocouples 260 are in direct contact with the material 240.

Figure 4:
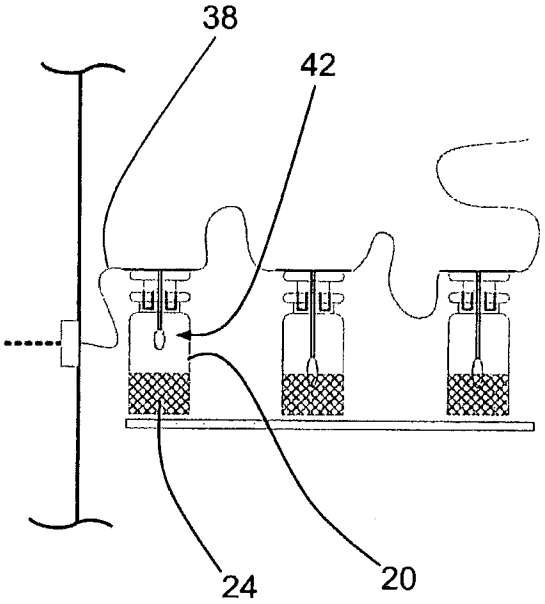
FIG. 4 shows a detail of the freeze dryer of FIG. 3.
Figure 5:
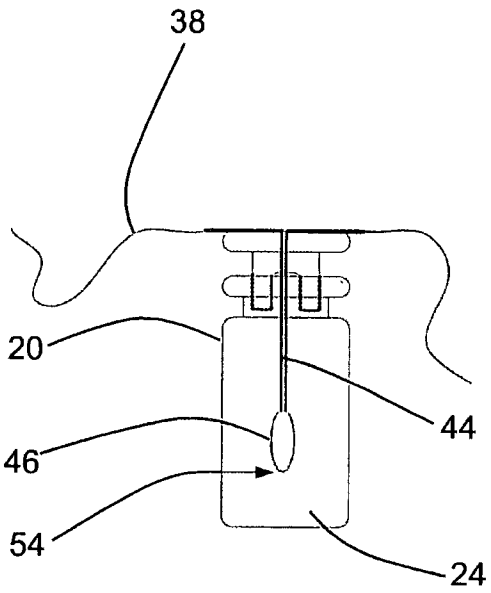
FIG. 5 shows a side sectional view of a vial within a freeze dryer according to a specific embodiment of the invention.

FIG. 3 to FIG. 5 show a specific embodiment of a freeze dryer 10 which includes a monitoring device 32 according to the invention. FIG. 3 further shows a drying chamber 12, a compressor 14, an ice condenser 16. In FIG. 4, which depicts a detail of the freeze dryer of FIG. 3, three vials 20 are shown which are filled with a material 24 to be dried. The monitoring device 32 includes a computer 34 having an interrogator 36 coupled therewith. The interrogator 36 has a number of n optical sensing fibers 38 (of which only one is shown in FIGS. 3 to 5) connected therewith. The fibers 38 are guided through a flange 40 into the interior of the drying chamber 12. As is shown in FIGS. 4 and 5, each fiber 38 is further guided through a number of vials 20. Moreover, FIG. 5 also shows a fiber 38 guided through a sensing rod, from which it extends with a curved section forming a loop 46. At the loop, the fiber 38 is provided with a fiber Bragg grating 54. In this specific embodiment, sensing rods 44 with fiber loops 46 exhibiting Bragg gratings 54 are serially positioned along a sensing fiber 38 to simultaneously monitor several vials 20. The sensing rods 44 are inserted into the vials 20, and the fiber loops 46 are positioned within and/or above the material 24 to be dried. The Bragg gratings 54 are positioned at medially located longitudinal sections of the sensing fiber 38.

In this embodiment, the fiber loop 46 further includes a tube or tubular holder (not shown in detail) in which the respective fiber 38 is positioned. The fiber 38 may be loosely inserted in the tubular holder and exhibit a very small degree of movability within the tubular holder. The fiber 38 was bent into the loop form by introducing it in the tubular holder in nearly straight form and the bending the tubular holder.

In the range of the fiber loop 46, e.g. at the lower tip of the loop 46, the fiber 38 includes a fiber Bragg grating 54 (not shown in detail). Such a fiber Bragg grating (FBG) is a type of distributed Bragg reflector constructed in a short segment of the fiber 38 that reflects particular wavelengths of light and transmits all others. This is achieved by adding a periodic variation to the refractive index of the fiber core, which generates a wavelength-specific dielectric mirror. A fiber Bragg grating can therefore be used as a wavelength-specific reflector.

Figure 6:
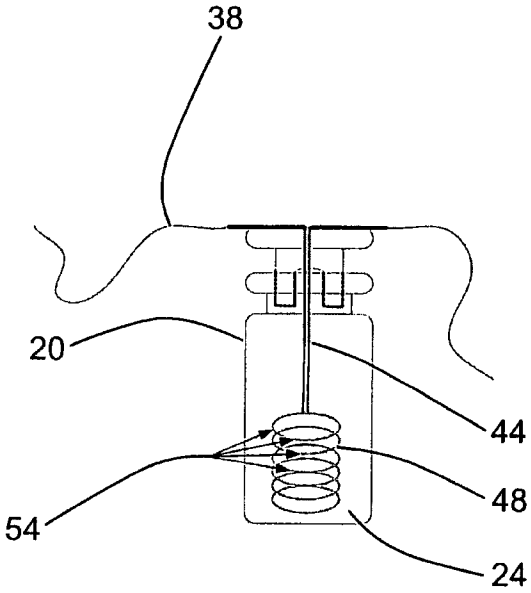
FIG. 6 shows a side sectional view of a vial within a freeze dryer according to a further specific embodiment of the invention.

FIG. 6 depicts a further specific embodiment according to which a sensing fiber 38 is guided through a sensing rod 44 and inserted into a vial 20. A medially located longitudinal section of the sensing fiber 38 extends from the sensing rod 44, forming a curved section here shaped as a helix 48. Preferably, the sensing helix 48 includes a tubular holder (not shown) around the sensing fiber 38 in which the fiber 38 may be movable. In this embodiment, the sensing helix 48 comprises multiple fiber Bragg gratings 54 providing multiple measuring spots within the interior of a vial 20, possibly forming a two or even three-dimensional pattern or array. Similarly, the curved section of the sensing fiber 38 comprising multiple Bragg gratings 54 could also be shaped into a spiral (not shown).

Figure 7:
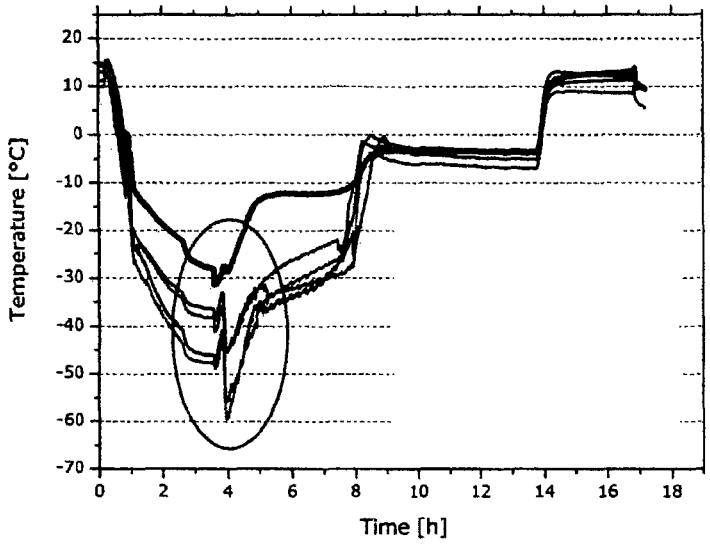
FIG. 7 shows a first chart of temperature measurements according to prior art and according to the invention.
Figure 8:
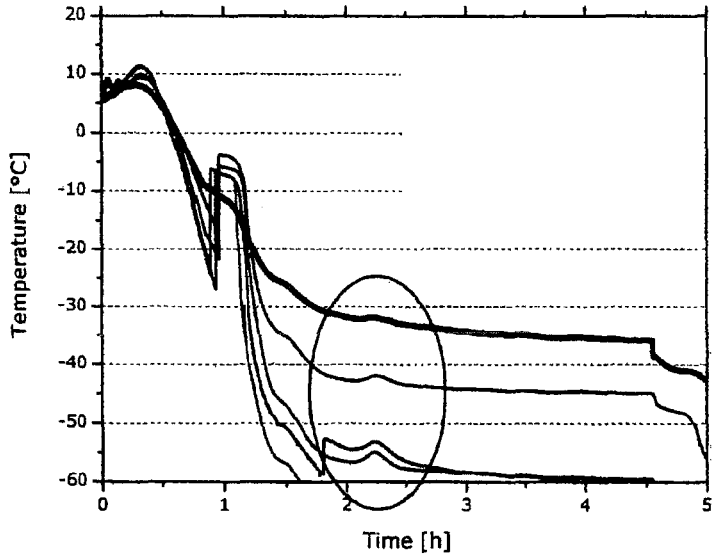
FIG. 8 shows a second chart of temperature measurements according to prior art and according to the invention.
Figure 9:
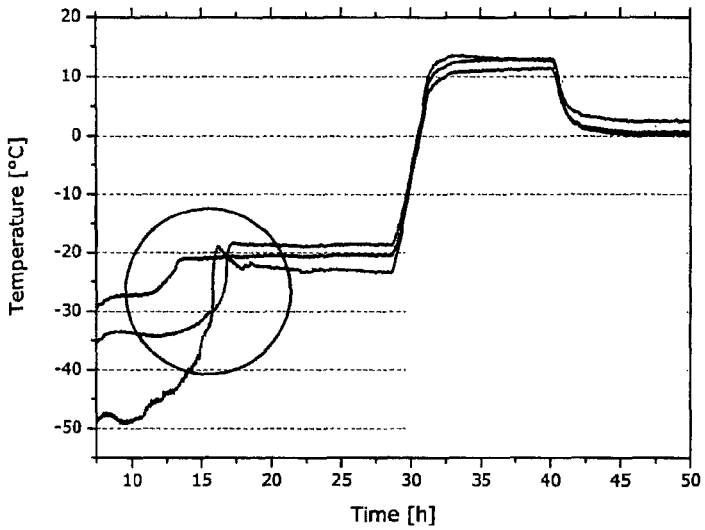
FIG. 9 shows a third chart of temperature measurements according to prior art and according to the invention.

FIG. 7 through 11 show charts of the temperature on the y-axis (axis of ordinates) along the time on the x-axis (axis of abscissae). Surprisingly, the results obtained with the monitoring device according to the invention using fiber Bragg gratings are far superior to the temperature measurements of the standard thermocouples. Referring to FIGS. 7 to 9, processes can be monitored at very high sensitivity and sampling rate. FIG. 7 shows temperature profiles measured and monitored using the sensor technique according to the invention. According to FIG. 8, temperature profiles allow monitoring additional processes during freezing, such as crystallization of excipients. FIG. 9 shows the end of primary drying and the sensitivity measured.

Further, these processes in the sample can be monitored by the temperature measurement without contact with the sample (see FIG. 4). In addition, the monitoring device according to the invention is much easier to handle due to the small size of the fiber sensors, and due to the handling flexibility, e.g. with less cables, multiple measurement points on one fiber line (see FIG. 4), the multiplex capacity (see FIG. 3) and the multiple measurement points in one vial (see FIG. 6).

Figure 10:
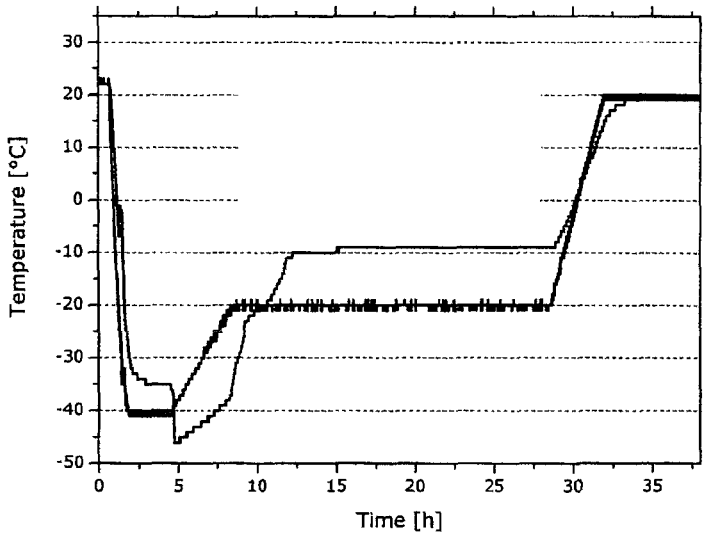
FIG. 10 shows a forth chart of temperature measurements according to prior art and according to the invention.
Figure 11:
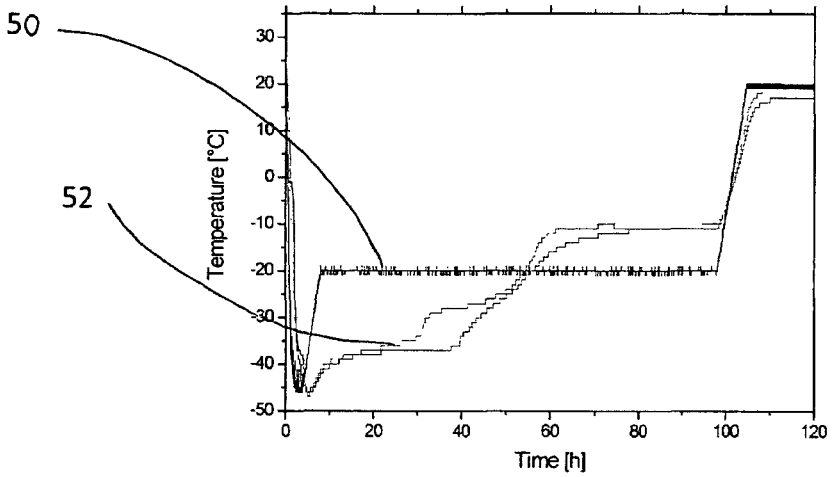
FIG. 11 shows a fifth chart of temperature measurements according to prior art and according to the invention.

In comparison, FIGS. 10 and 11 show temperature profiles as obtained with conventional thermocouples or resistance detectors, measured in the shelf (curve 50) and in a sample material (curve 52).

Figure 12:
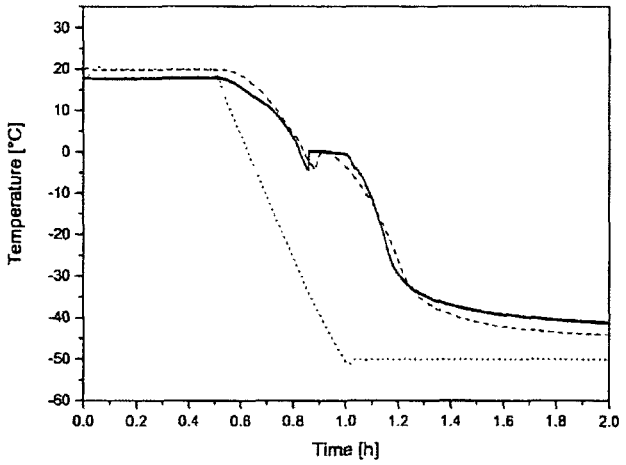
FIG. 12 shows a chart of temperature measurements according to the invention using a vial containing water.

FIG. 12 shows temperature profiles recorded during a cooling cycle in a freeze dryer according to a specific embodiment of the invention, using a relatively high cooling rate of 2.5 K per minute. The freeze dryer included a monitoring device featuring a sensing fiber which was guided through five sensing rods as depicted in FIGS. 4 and 5, each of which was inserted into a vial containing purified water such as to be in contact with the water. A further vial containing purified water was equipped with a conventional thermocouple which also reached into the water. The vials were placed on a shelf whose inlet temperature (e.g. the temperature of the cooling medium entering the cooling channels within the shelf) was monitored by conventional means, using a resistance temperature detector. The graph shows the temperature profiles as measured by the fiber sensor at one selected vial (— "solid line"), the thermocouple ( - - - "dashed line"), and at the cooling medium inlet of the shelf ( . . . "dotted line"). The graphs indicate that the temperature measured at the shelf inlet cannot be used to estimate the temperature at a sample such as a vial. Both the optical sensor and the thermocouple show a thermal event just below 0° C. between 0.8 and 0.9 hours which indicates the freezing of the water in the vials.

Figure 13:
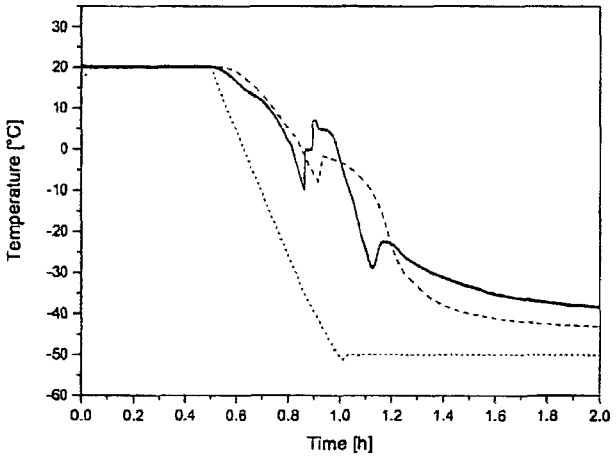
FIG. 13 shows a chart of temperature measurements according to the invention using a vial containing a mannitol solution.

FIG. 13 shows further temperature profiles during a cooling cycle in a freeze dryer according to a specific embodiment of the invention, using the same setup and cooling rate as in FIG. 12, except that the vials contained a mannitol solution instead of purified water. In this case, not only the freezing of the solution is detected. In addition, the monitoring device according to the invention which includes the optical sensing fiber having a fiber Bragg grating shows a further thermal event at approx. 1.1 hours which clearly indicates the crystallisation of mannitol. In contrast, the conventional thermocouple was not capable of detecting this physical change in the sample material.

Figure 14:
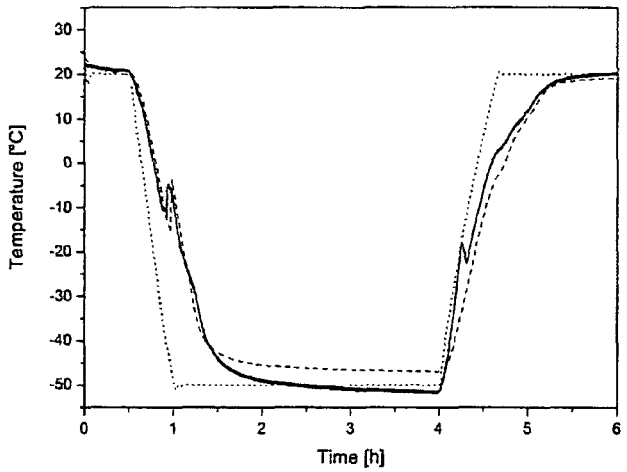
FIG. 14 shows a chart of temperature measurements according to the invention using a vial containing a trehalose solution.

FIG. 14 shows further temperature profiles during a freezing (cooling) and thawing (heating) cycle in a freeze dryer according to a specific embodiment of the invention, using the same freezing rate of 2.5 K/min. The vials contained a 20 wt.-% trehalose solution. In this case, the optical sensor fiber was glued into a groove cut into the bottom of the vials. Again, the graph shows the temperature profiles as measured by the fiber sensor at one selected vial (— "solid line"), the thermocouple ( - - - "dashed line"), and at the cooling medium inlet of the shelf ( . . . "dotted line"). During cooling, both the optical sensor and the thermocouple exhibit a thermal event indicating the freezing of the solution. During subsequent heating, only the optical sensor having the fiber Bragg grating, but not the thermocouple, shows an event between 4 and 5 hours at the glass transition temperature of trehalose. This illustrates the remarkable sensitivity of the monitoring device of the invention. With conventional methods and devices, glass transitions of samples in vials cannot normally be detected. The temperature profile as measured according to the invention rather corresponds to that obtained by a scanning calorimetric run (not shown) in which, during the cooling phase, the respective trehalose sample only exhibits an exothermal peak at approx. −17° C. (indicating crystallisation), whereas the glass transition (occurring at approx. −30° C.) is only detected during the heating phase.

Figure 15:
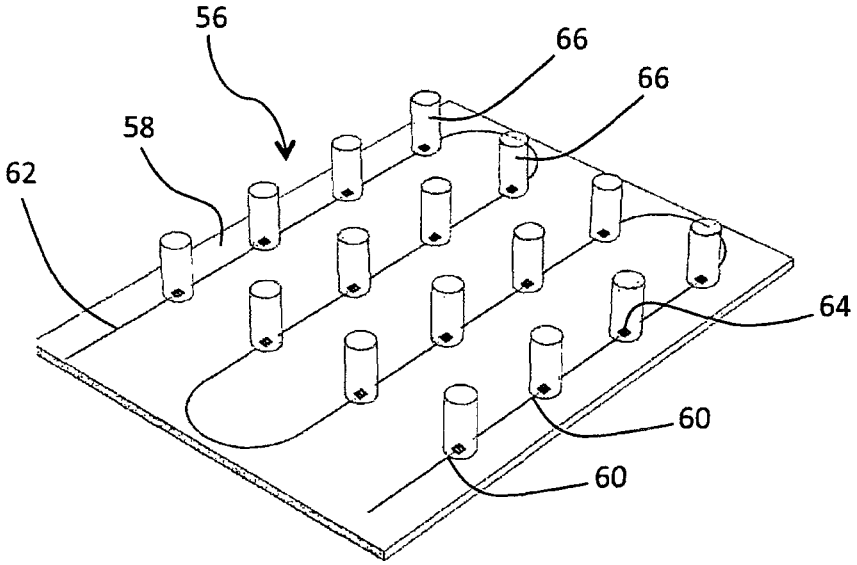
FIG. 15 shows a three dimensional view of a support unit according to a further embodiment of the invention.

In FIG. 15 a support unit 56 is shown according to a further embodiment of the invention. The support unit 56 as shown comprises a flat plate, a flat grate or the like 58. The support unit 56 can also be designed with several levels, e.g. several plates arranged above each other. The surface of the support unit 56 comprises several supporting areas 60 at which sample containers, e.g. vials 66 or the like, or even a sample material itself (without a container) can be placed. The supporting areas 60 can simply be provided by certain regions on the support unit 56, which are preferably marked as supporting areas 60. Optionally, the supporting areas 60 may be recessed into the plate 58.

According to a specific embodiment of the invention, a sensing fiber 62 traverses multiple supporting areas 60. The sensing fiber 62 can be arranged on the surface of the support unit 56. For example, the fiber can be glued onto the surface, fixed by mechanical fasteners or held by other attachments systems. Also the sensing fiber 62 may be embedded or incorporated into the support unit 56 and emerge to the surface only at the location of the supporting areas 60. The sensing fiber may run along the support unit 56 in a straight line, or it may traverse the support unit 56 in loops, a sinuous line or the like to traverse a large part of the surface of the support unit 56. The sensing fiber 62 may be connected to an interrogator and/or a computer as shown in FIG. 3.

The sensing fiber 62 is provided with at least one fiber Bragg grating 64 at each supporting area 60. There can be several fiber Bragg gratings 64 arranged at one supporting area 60. In this case several sensors are provided for one supporting area. The sensing fiber 62 may be configured in loops or circles within the range of a supporting area 60. Such several fiber Bragg gratings 64 can be arranged within a small range.

In FIG. 15 a number of vials 66, each of which may contain a sample to be measured, are placed on each supporting area 60 and thereby on the fiber Bragg gratings 64. In this way, the temperature at each vial 66 placed on a supporting area 60 of the support unit 56 can be monitored with one single sensing fiber 62. In addition, the weights of the vials may be monitored simultaneously. According to this embodiment, there is no need to shape and arrange the fiber sections having the Bragg gratings 64 into specific forms which are insertable into vials. A large number of vials 66 can be easily monitored with the same measuring conditions. The sensing fiber 62 also can serve as a contact surface for the vials 66. By the arrangement of the sensing fiber 62 in loops or circles or the like, several contact points for each vial can be provided. Preferably the contact points of the sensing fiber 62 include the fiber Bragg gratings 64.

Figure 16:
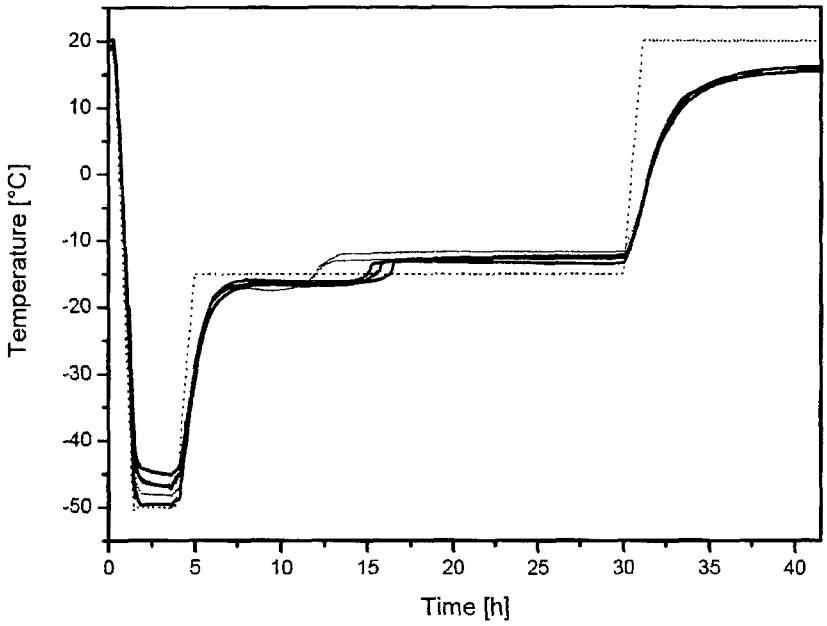
FIG. 16 shows a chart of temperature measurements according to the invention using vials filled with sucrose solution and vials filled with mannitol solution.

FIG. 16 depicts the temperature profiles obtained from a monitoring device according to the invention, which was used in a freeze drying cycle to which 2R vials filled with either 1 ml of filtrated (0.2 μm) 5 wt.-% mannitol solution or 1 ml of filtrated (0.2 μm) 10 wt.-% sucrose solution were subjected. In this case, a supporting unit similar to that shown in FIG. 15 was used in which a sensor fiber was incorporated within a groove cut into the top surface of the supporting unit such that the sensor fiber was aligned with that surface. The sensing fiber was provided with multiple Bragg gratings so that multiple sensing loci were available. The vials were placed onto the support unit at the sensing loci, i.e. at the Bragg gratings of the fiber.

The graph shows temperature profiles measured at vials during the initial cooling phase, the primary drying phase, and the secondary drying phase, as well as the temperature profile as measured at the respective shelf inlet for the cooling medium. The three bold solid lines (—) show the temperature profiles at three different vials filled with mannitol solution, the two fine solid lines (—) show the temperature profiles at two different vials filled with sucrose solution, and the dotted line ( . . . ) shows the temperature profile of the shelf or cooling medium. The graph indicates, inter alia, the end of the primary drying phase which occurs at approx. 12-13 hours in the case of sucrose solution and after approx. 15-17 hours in the case of the mannitol solution, as reflected by a temperature rise from a first plateau to a second plateau. Furthermore, it demonstrates that the monitoring device of the invention is capable of measuring temperatures with great resolution, without affecting the product and/or, according to this particular embodiment, without even being in direct contact with the product. The differences between the vials filled with sucrose solution and those filled with mannitol solution are clearly shown, but also the smaller differences in the temperature profiles of vials containing the same type of product. In view of the fact that a further multiplication of the sensing loci is easily possible, it is clear that the monitoring device of the invention provides a highly efficient and convenient means to extensively and reliably monitor a drying process and the content of a dryer during the process, even if the dryer content includes a large number of vials placed in various positions.

| Reference Numerals | |
|---|---|
| 10 | freeze dryer |
| 12 | drying chamber |
| 14 | compressor |
| 16 | ice condenser |
| 18 | door |
| 20 | vial |
| 22 | rack |
| 24 | material |
| 26 | thermocouple |
| 28 | temperature measuring device |
| 30 | electrical conduct |
| 32 | freeze dryer monitoring device |
| 34 | computer |
| 36 | interrogator |
| 38 | fiber |
| 40 | flange |
| 44 | sensing rod |
| 46 | fiber loop |
| 48 | sensing helix |
| 50 | curve |
| 52 | curve |
| 54 | fiber Bragg grating |
| 56 | support unit |
| 58 | support plate |
| 60 | supporting area |
| 62 | sensing fiber |
| 64 | fiber Bragg grating |
| 66 | vial |
| 100 | freeze dryer |
| 120 | drying chamber |
| 140 | compressor |
| 160 | ice condenser |
| 180 | door |
| 200 | vial |
| 220 | rack |
| 240 | material |
| 260 | thermocouple |
| 280 | temperature measuring device |
| 300 | electrical conduct |

The invention claimed is:

1. A dryer for drying a material comprising a monitoring device, wherein the monitoring device includes a means for sensing a physical parameter at a sensing locus within the dryer, the means comprising an optical sensing fiber having at least one fiber Bragg grating to directly react to actionable physical parameters, the monitoring device also including means to control drying parameters, and wherein the at least one fiber Bragg grating is positioned at the sensing locus such that the monitoring device allows for a precise control of the drying process of the material therein.

2. The dryer of claim 1, wherein the physical parameter is a temperature or a force.

3. The dryer of claim 1, wherein the at least one fiber Bragg grating is in a medially located longitudinal section of the sensing fiber.

4. The dryer of claim 1, wherein at least a portion of the sensing fiber is located in a tubular holder, which portion preferably includes the at least one fiber Bragg grating.

5. The dryer of claim 1, wherein the section in which the at least one fiber Bragg grating is located is a curved section, the curved section preferably being curved over an angular range of at least 180°.

6. The dryer of claim 5, wherein the curved section forms a loop, a spiral, a circle, an ellipse, or a helix.

7. The dryer of claim 5, wherein the curved section is insertable into a container holding a material which is to be dried.

8. The dryer of claim 5, wherein the curved section extends from a sensing rod through which the sensing fiber is guided.

9. The dryer of claim 1, wherein the sensing fiber is affixed to, or incorporated in, a support unit adapted to support a material which is to be dried, the material preferably being contained in at least one container resting on the support unit.

10. The dryer of claim 1, including a means for sensing a physical parameter at a plurality of sensing loci within the dryer, the means comprising an optical sensing fiber having a plurality of fiber Bragg gratings which are positioned serially in distinct medially located longitudinal sections of the sensing fiber.

11. The dryer of claim 1, wherein the sensing fiber is connected to an interrogator, and wherein the interrogator is preferably coupled with a computer.

12. The dryer of claim 1, comprising a plurality of sensing fibers.

13. The dryer of claim 1, wherein the dryer is preferably a freeze dryer.

14. A method for drying a material comprising the steps of using a freeze dryer comprising a monitoring device, wherein the monitoring device includes a means for sensing a physical parameter at a sensing locus within the dryer, the means comprising an optical sensing fiber having at least one fiber Bragg grating to directly react to actionable physical parameters, the monitoring device also including means to control drying parameters, and wherein the at least one fiber Bragg grating is positioned at the sensing locus such that the monitoring device allows for a precise control of the drying process of the material therein.

15. A dryer for drying a material comprising a monitoring device, wherein the monitoring device includes a means for sensing a physical parameter at a sensing locus within the dryer, the means comprising an optical sensing fiber having at least one fiber Bragg grating and wherein the at least one fiber Bragg grating is positioned at the sensing locus and, wherein the sensing fiber is a Draw Tower Grating (DTG) fiber.

16. A monitoring device for use with a dryer, wherein the monitoring device includes a means for sensing a physical parameter at a sensing locus within the dryer, the means comprising an optical sensing fiber having at least one fiber Bragg grating to directly react to actionable physical parameters such that the monitoring device allows for a precise control of the drying process of the material in the dryer.

* * * * *